United States Patent [19]

Neuhauser et al.

[11] Patent Number: 4,683,764

[45] Date of Patent: Aug. 4, 1987

[54] PUMP DRIVE FOR DEEP WELL PUMPING INSTALLATIONS

[75] Inventors: Johannn Neuhauser; Hans-Joachim Brauch, both of Salzgitter, Fed. Rep. of Germany

[73] Assignee: Salzgitter Maschinen und Anlagen Aktiengesellschaft, Salzgitter, Fed. Rep. of Germany

[21] Appl. No.: 693,804

[22] Filed: Jan. 22, 1985

[30] Foreign Application Priority Data

Jan. 20, 1984 [DE] Fed. Rep. of Germany ..... 3401850

[51] Int. Cl.[4] ..... F04B 47/02

[52] U.S. Cl. ..... 74/41; 74/522

[58] Field of Search ..... 74/41, 108, 522

[56] References Cited

U.S. PATENT DOCUMENTS

| | | | |
|---|---|---|---|
| 1,751,767 | 3/1930 | Sperry | 74/41 |
| 1,885,675 | 11/1932 | Black | 74/41 |
| 1,912,246 | 5/1933 | Barrett | 74/41 |
| 2,079,276 | 5/1937 | Bloss | 74/41 |
| 2,199,583 | 5/1940 | Athy | 74/41 |
| 2,287,604 | 6/1942 | Comstock | 74/103 |
| 3,029,650 | 4/1962 | Byrd | 74/41 |
| 4,092,872 | 6/1978 | McClure | 74/41 |

*Primary Examiner*—Lawrence Staab

*Attorney, Agent, or Firm*—Michael J. Striker

[57] ABSTRACT

A tiltable horse-head shaped transmission part at the end of a rocking beam of a cornish type pump drive, is pivotably supported at one end portion of the rocking beam. The rocking beam is pivotably supported on a stationary stand. The horse-head transmission part is mounted in bearing blocks which are shiftable in longitudinal direction of the rocking beam and at the same time are tiltable about an axis which extends parallel to the longitudinal direction of the rocking beam. In this manner an accurate adjustment of the horse-head transmission part relative to a polished rod in the bore hole is made possible so that the polished rod can be accurately guided in corresponding stuffing boxes. The horse-head shaped transmission part is provided with two force application points serving for introducing tilting movement in a backward direction toward a stand and in a forward direction away from the bore hole. The force application points are equipped with fastening means for the attachment of a pulling rope. The arrangement of the force application points relative to the center of gravity of the transmission part and to its pivot axle is such that during the tilting movement of the horse-head transmission part in either direction, its center of gravity passes its upper dead center point before the force application point being used reaches its top dead center.

8 Claims, 10 Drawing Figures

PUMP DRIVE FOR DEEP WELL PUMPING INSTALLATIONS

BACKGROUND OF THE INVENTION

The present invention relates in general to drives for deep well pumping installations. Pump drives of this kind include a stationary stand, rocking beam pivotable about a substantially horizontal first axis on the stand, a horse-head shaped rocking member which is pivotably supported on the rocking beam for a tilting movement about a second axis which extends transversely to the longitudinal axis of the rocking beam.

In pumping devices of this kind, used for example in recovering liquid from deep bore holes it is known to mount the horse-head piece on the rocking beam for tilting movement about an axis which extends transversely to the longitudinal axis of the rocking beam so that drilling or installation or maintenance operations in the range of the bore hole or of the pumping device can be performed. By tilting the rocking horse-head piece backwards, that means away from the bore hole, a lifting tool acting in vertical direction can be applied without problems. During the backward tilting movement of the horse-head piece, that means from a striking position into a position in which the aforementioned operations in the range of the bore hole, are performed, care must be taken that the horse-head piece, after passing the upper dead center of its path of movement does not drop on the rocking beam. This problem may occur also during the forward tilting movement of the horse-head piece. If during the forward tilting movement the horse-head piece strikes the rocking beam, hazardous, sparks may be created. For applying a pulling rope by means of which in cooperation with a lifting tool the aforementioned tilting movements are performed, in prior art horse-head pieces the operator must have stepped on the rocking beam in order to attach the pulling rope. This operation is not only unsafe but also very time consuming. In order to achieve an accurate vertical guide of the connection between the deep well pump and the polished rod engaging the horse-head piece, a certain adjustability of the position of the horse-head relative to the rocking beam must be provided. Conventional adjustment devices used for this purpose are complicated in construction and expensive in manufacture and moreover during practical operation they have the disadvantage that the operator cannot reach the individual setting elements from a single working position.

SUMMARY OF THE INVENTION

It is therefore an general object of the present invention to overcome the disadvantages of the pumping installation of this kind.

More particularly, it is an object of this invention to provide such an improved support for the rocking horse-head piece and to provide such a configuration of the latter that its operability is substantially improved in comparison with prior art.

Another object of this invention is to provide an improved tiltability of the horse-head piece during the drilling, installation or maintenance operations in the range of the bore hole.

In keeping with these objects and others which will become apparent hereafter, one feature of the invention resides, in a pumping device of the afore-described kind, in the provision of the rocking horse-head member of such a configuration as to determine two force application points which are spaced apart from each other and from said second pivot axis so as to impart to the horse-head piece either a backward pivot movement or a forward pivot movement about the second pivot axis, the force application points being arranged relative to a center of gravity of the horse-head piece such that during the tilting movement of the horse-head piece in either direction the center of gravity precedes only that force application point being used in going past their respective individual force application points pass their corresponding dead center points on their path of movement.

In accordance with this invention, a force application point is assigned both for the forward pivot movement and for the backward pivot movement. The force application point is to be understood as certain construction feature which permits the attachment of a pulling rope of a lifting tool. It is of importance that the claimed arrangement of the force application points relative to the center of gravity of the horse-head piece as well as to the pivot axis of the latter be such that the applied rope be continuously under a pulling load and consequently along the entire path of movement of the horse-head piece during its pivoting an. unambiguous guiding action is obtained which prevents particularly an override or drop of the horse-head piece on the rocking beam and the generation of sparks.

The construction elements for attaching a pulling rope in the force application points can be either in the form of hooked eyelets or yokes into which a hook on the pulling rope can be suspended without the necessity for the operator to step on the rocking beam. In this manner a substantial improvement in the lock safety is achieved.

The second pivot axis for the horse-head piece is offset relative to the center of gravity in such a manner that even at an extreme inclination angle of the rocking beam and at a tilted position of the horse-head piece in backward direction the gravity generates an arresting movement with regards to the second axis and locks the horse-head piece in this position. As a consequence, in the slung back position, that means in a position retracted from the working position, the horse-head piece is safeguarded against over swing on the rocking beam irrespective of the angular position of the latter. An accurate measure of the offset between the second axis and the center of gravity of the horse-head piece must be adjusted in conformity with the momentary maximum inclination angle of the rocking member. When the horse-head piece is secured in a position in which the rocking beam has its maximum inclination relative to the bore hole axis, it is simultaneously guaranteed that the horse-head piece is secured also in all remaining positions of the rocking beam. A return movement of the horse-head piece can be thus made in any position of the rocking beam without the danger of accidents.

Relative to the bore hole, it is guaranteed that the clamping is secured in all remaining positions of the rocking beam.

In the preferred embodiment of this invention, the horse-head piece is supported for tiling movement in mounting means which are shiftable in longitudinal direction of the rocking beam and at the same time are tiltable about an axis extended parallel toward the longitudinal axis of the rocking beam. The shifting of the axial pins in the bearing bushings can be affected for example by means of adjustment screws acting in the direction of the second pivot axis.

It will be noted that in a variation of the last mentioned movement of the pivot axis of the horse-head, an embodiment can be considered in which the pivot axis is shiftable in its axial direction so that the position of the horse-head piece relative to the bore hole is adjustable in addition to its adjustability in longitudinal direction of the rocking beam.

The novel features which are considered as characteristic for the invention are set forth in particular in the appended claims. The invention itself however both as to its construction and its method of operation, together with additional objects and advantages thereof will be best understood from the following description of specific embodiments when read in connection with the accompanying drawing.

DESCRIPTION OF THE PREFERRED EMBODIMENTS

Figure 1:
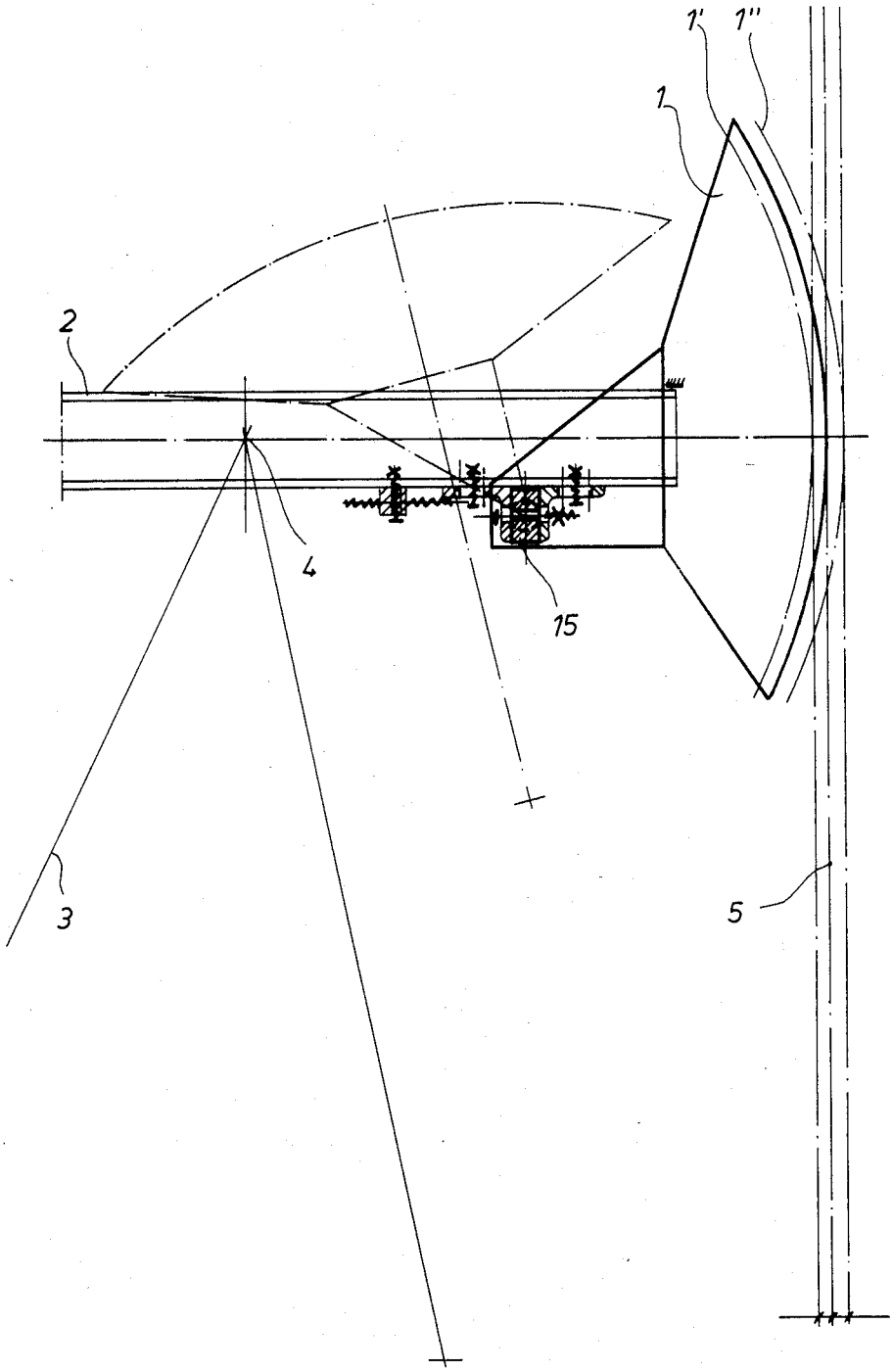
FIG. 1 is a schematic side view of the a drive according to this invention for a deep well pumping installation.
Figure 2:
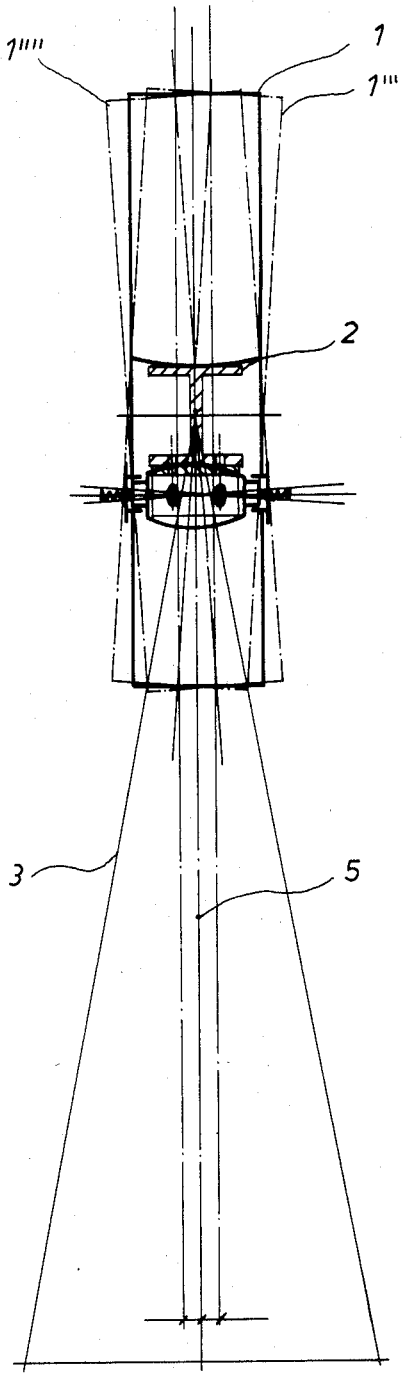
FIG. 2 is a front view, partly in section, of the drive of FIG. 1, taken along the line II.
Figure 3:
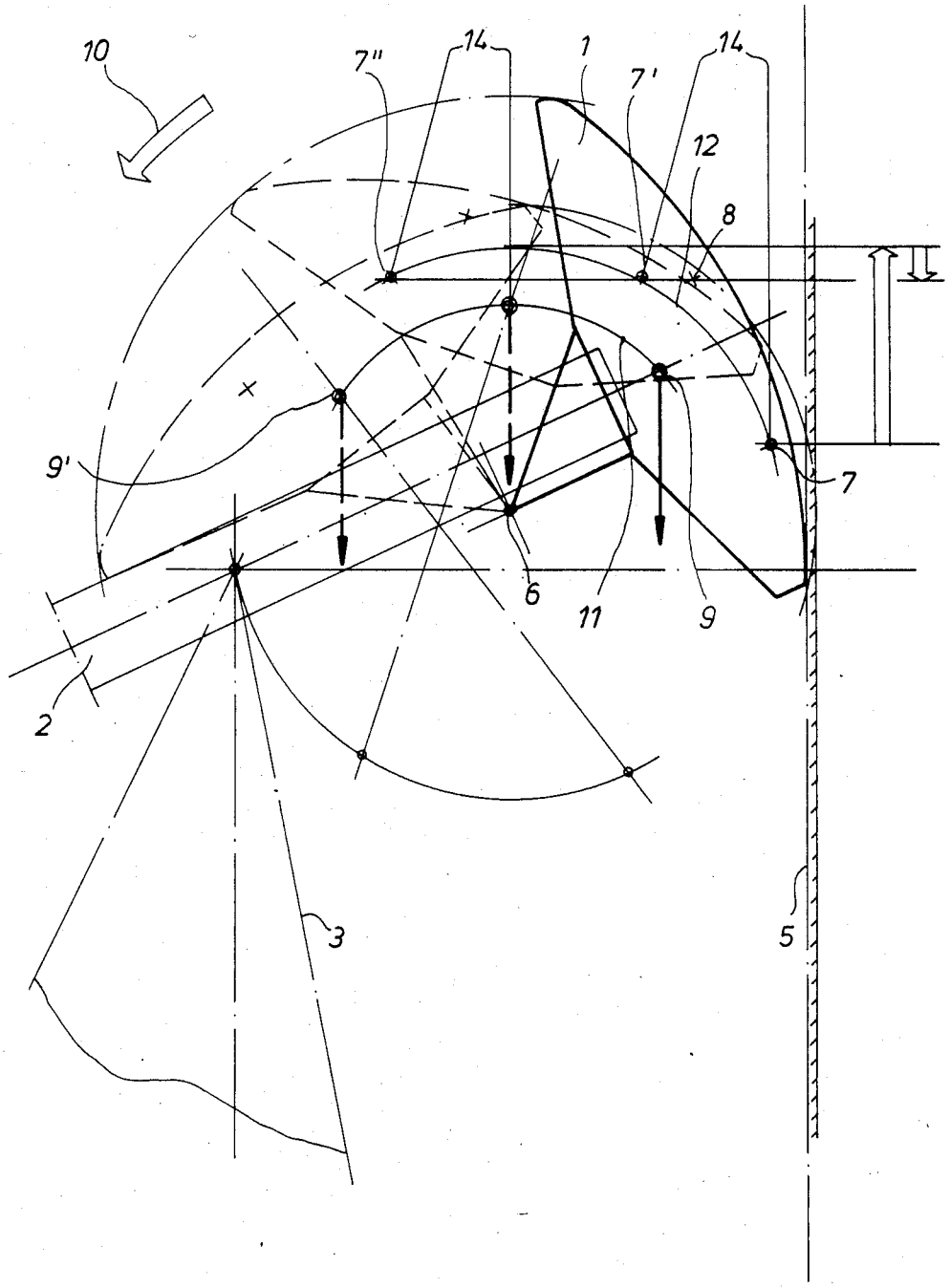
FIG. 3 is a side view of a deep well pumping drive of this invention shown before the beginning of the backward tilting movement of the horse-head piece.
Figure 4:
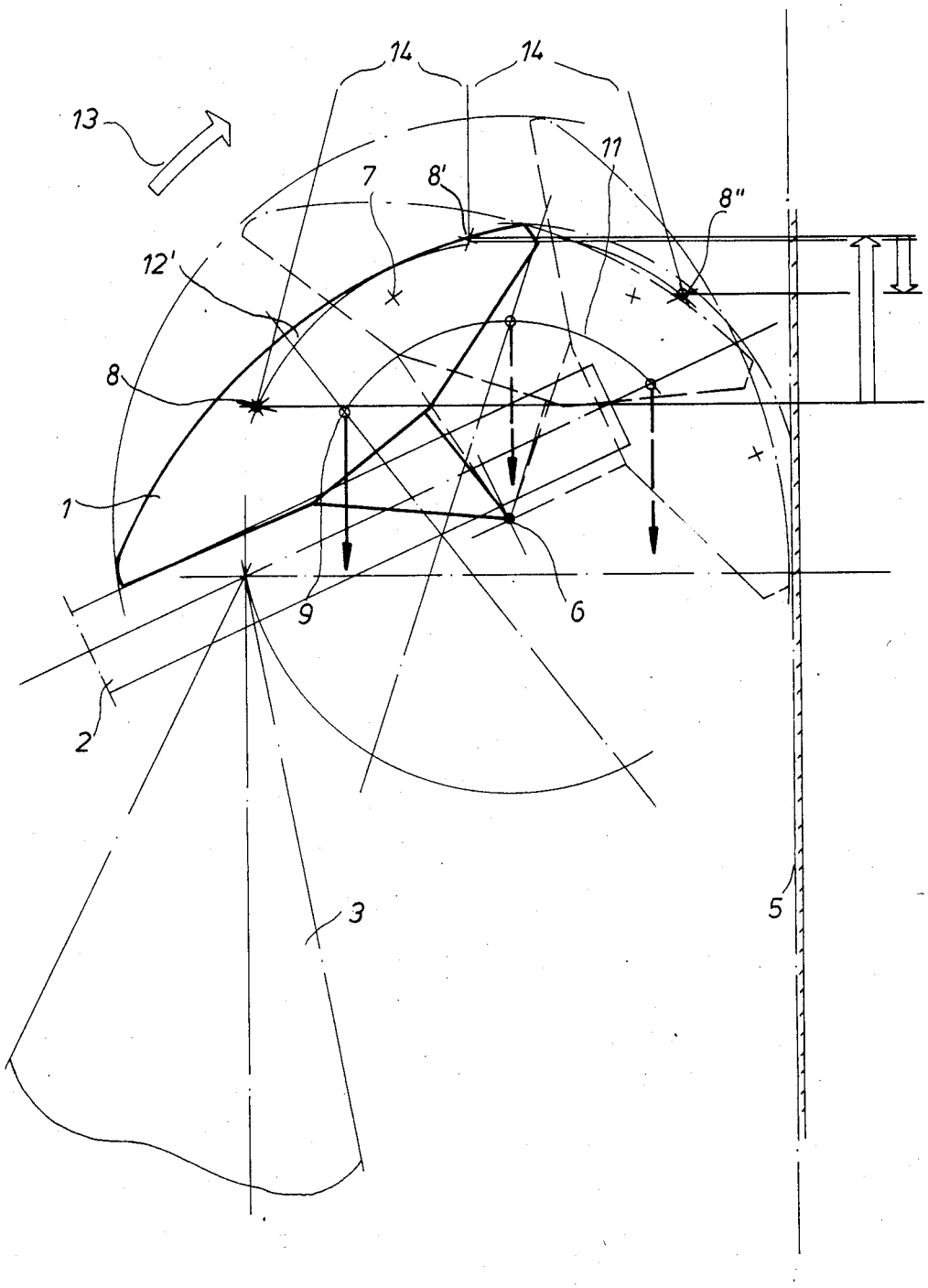
FIG. 4 is a side view of the driving member for a deep well pumping installation before the beginning of the forward tilting movement of the horse-head piece.

In FIG. 1 reference numeral 1 denotes a horse-head shaped member of a known drive for deep well pumping installation used for example in pumping oil from a deep oil well. As it will be explained in greater detail below, the horse-head piece is supported on a rocking beam 2 of the pump drive. The rocking beam 2 is supported on a schematically illustrated stand 3 for performing a rocking movement about an axis 4 extending at right angles to the plane of the drawing. The entire driving system consisting of the horse-head piece 1 and the rocking beam 2 is brought by non-illustrated engine cranks and via a non-illustrated cross piece which is coupled to the end of the rocking beam 2 remote from the horse-head piece, into an oscillatory movement about the axis 4. The stand 3 during the entire operation of the pumping installation remains stationary.

Reference numeral 5 denotes a polished rod of the deep well pumping drive which at one end thereof is immediately connected by a rope to the horse-head piece and at the other end is connected to the pumping linkage proper. The actual deep well pumping device is well known from art and need not be explained in detail in connection with this invention.

In FIGS. 2 through 10, operational elements which correspond to those shown in FIG. 1, are designated by like reference characters. The before-mentioned polished rod 5 which cooperates with the pumping linkage proper is guided in packing or stuffing boxes. During operation of pump drives of this kind an accurate alignment of the rocking horse-head piece 1 with the polished rod 5 is necessary. This requirement is met in the pumping drive of this invention by shiftably supporting the rocking horse-head piece 1 parallel to the longitudinal axis of the rocking beam 2 and in addition the horse-head piece is pivotably supported on an axis which extends parallel to the longitudinal axis of the rocking beam 2. These combined shifting and tilting movements of the horse-head piece are indicated by dashed lines 1' or 1''. Structural details of this shiftable or tiltable mounting parts for the horse-head piece 1 will be explained below.

In order to facilitate maintenance or repair work in the bore hole or on its installation, which require a trouble-free access in vertical direction to the bore hole, the horse-head piece 1 is pivotably supported on an axis 6 mounted on the rocking beam 2. In this manner it is possible to tilt the horse-head piece from its working position illustrated in FIG. 3 into a back swung position illustrated in FIG. 4. In the working position the horse-head 1 can be arrested relative to the rocking beam 2 by arresting screws for example. In order to perform the swinging movement about the axis 6, the horse-head piece 1 is provided with force application points 7 and 8 which can be for example in the form of hooked eyelets, yokes and the like. The arrangement of these force application points on the horse-head piece is preferably such as to enable a lateral attachment of a pulling rope loaded by a power driven winch or other kind of lifting tool. The force application point 7 services for tilting the horse-head piece 1 from the position illustrated in FIG. 3 into a back swung position illustrated in FIG. 4. This tilting movement is related to the center of gravity 9 of the horse-head piece in such a manner that in tilting the latter in the direction of arrow 10, the center of gravity 9 passes its top dead center point before the force application point 7 reaches its top dead center point. The top dead center points in the these connections are to be understood those points on the path of movement 11 of the center of gravity 9, and of the path 12 of movement of the force application point 7 at which the points 9 or 7 are vertically above the axis 6. The reference numerals 7' and 7'' indicate those points on the path of movement 12 of the force application point 7 at which the center of gravity has already reached its top dead center point. The reference numeral 7'' indicates the terminal point of the path of movement 12 in the direction of arrow 10. In this swung back position the center of gravity 9 is in a position 9.

The forward pivot movement of the horse-head piece 1 indicated by arrow 13 is performed by the application of force at the point 8. It will be seen that the position of the force application point 8 relative to the center of gravity 9 as well as to the pivot axis 6 is such that during the tilting in the direction of arrow 13 the center of gravity again reaches its top dead center point on the path 11 before the force application point 8 passes its corresponding top dead center point on the path 12'. Reference numerals 8' and 8'' again designate characteristic points on the path of movement 12' of the point 8. In the position 8' the center of gravity 9 has just passed its top dead center point on the path 11 whereas the position 8'' denotes the terminal point of the movement of the force application point 8 during the tilting of the horse-head piece 1 in the direction of arrow 13. It will be recognized that the tilting movement of the horse-head piece 1 both in the backward direction of arrow 10 and in the forward direction of arrow 13 is characterized by the fact that the pulling rope 14 is continuously under load over the length of the path of movement of the points 7 and 8. Before the force application points reach their respective top dead center points on their path 12 or 12', the horse-head piece 1 due to the position of its center of gravity 9 is urged by the force of gravity into its end position and consequently after overriding this dead center point any subsequent motion of the horse-head piece 1 is braked by the pulling rope 14. The horse-head piece 1 therefore is subject at any point of its tilting movement to a well-defined guiding action.

The bearing support of the horse-head piece 1 is mounted at the bottom side of the rocking beam 2 whereby a pivot axis 15 which is not rotatable relative to the rocking beam 2, takes over the function of the axis 6. In the embodiment shown in FIGS. 5 and 7 the cross-section of the axis 15 is rectangular. The pivot axle 15 is supported in a bearing bushing 16 which is fastened by screws to the rocking beam 2. The screws pass through elongated openings 17 extending in the longitudinal direction of the rocking beam. A screw spindle 19 engaging a thrust block 20 on the rocking beam, is connected to the bearing bushing 16. The spindle 19 is controlled at point 21 by any suitable device for turning the spindle.

Figure 5:
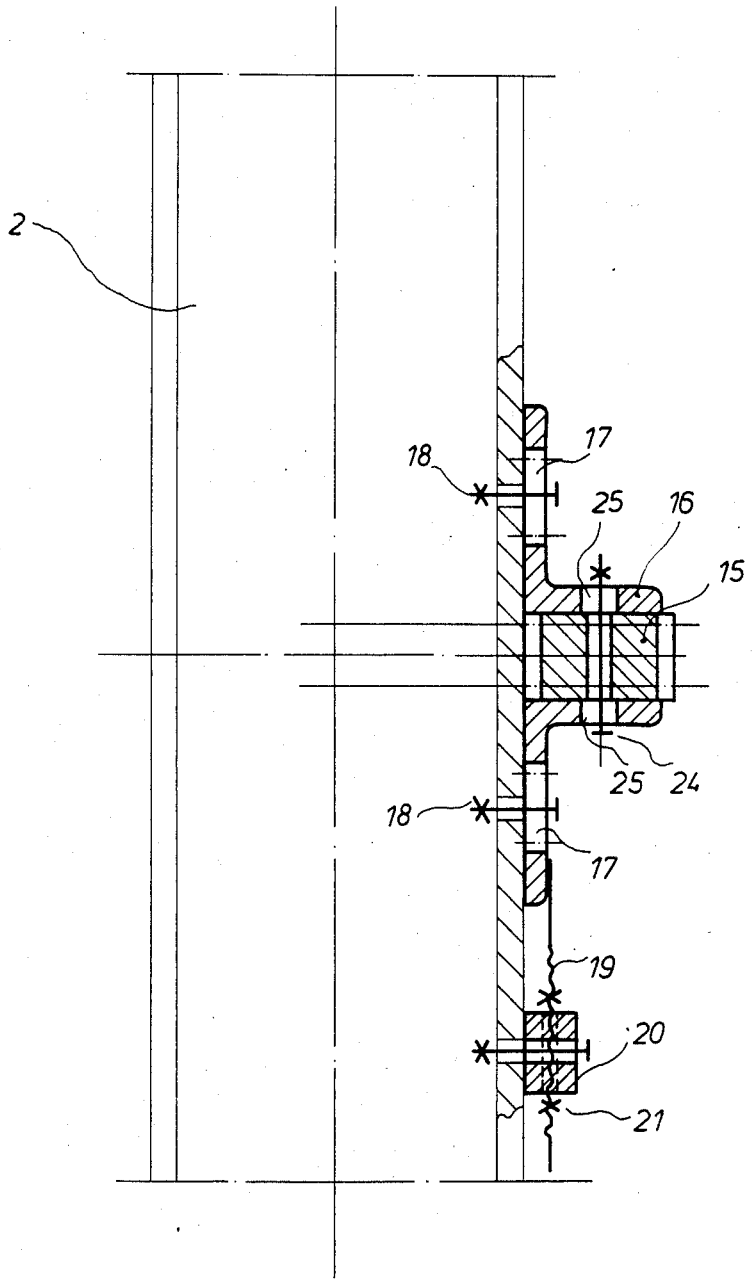
FIG. 5 is a longitudinal section of a part by means of which the horse-head piece is shiftable in longitudinal direction of the rocking beam, shown in an intermediate position.
Figure 6:
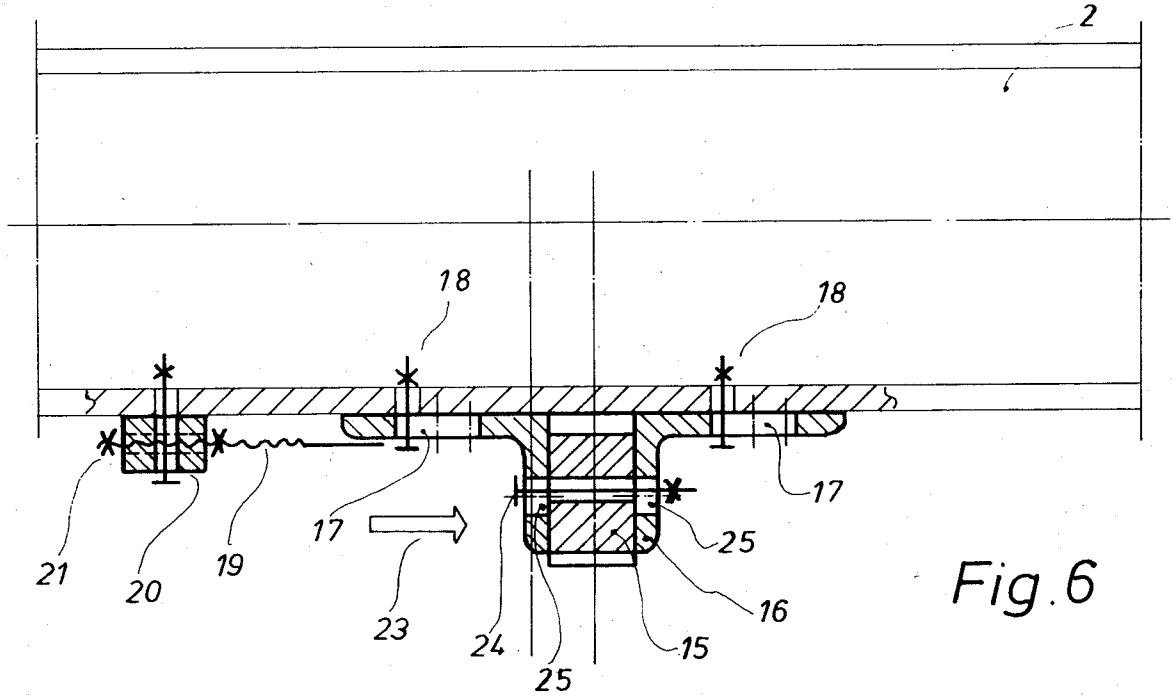
FIG. 6 is a sectional side view of the bearing support of FIG. 5 shown in an extreme position.
Figure 7:
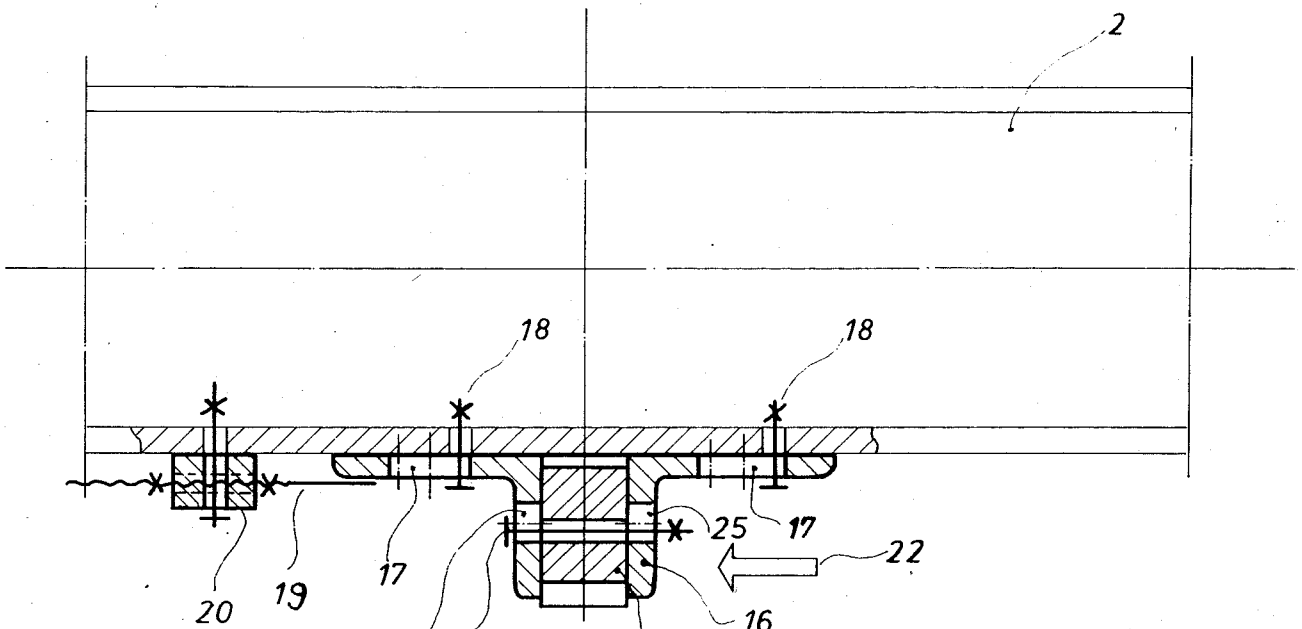
FIG. 7 shows a bearing support of FIG. 5 in another extreme position.

For the sake of clarity in the embodiments in FIGS. 5 through 7 the horse-head piece 1 which is mounted on the pivot axis 15, is not illustrated. A longitudinal shifting of the horse-head piece 1 parallel to the longitudinal axis of the rocking beam in the direction 22 or 23 is carried out as follows:

Firstly, the screws are slightly released and subsequently by means of the actuation device 21 the spindle 19 is rotated in the desired direction of the displacement (arrows 22, 23). The extent to which the displacement of the bearing bushing 16 can be adjusted is determined of course by the length of the oblong opening 17.

Figure 8:
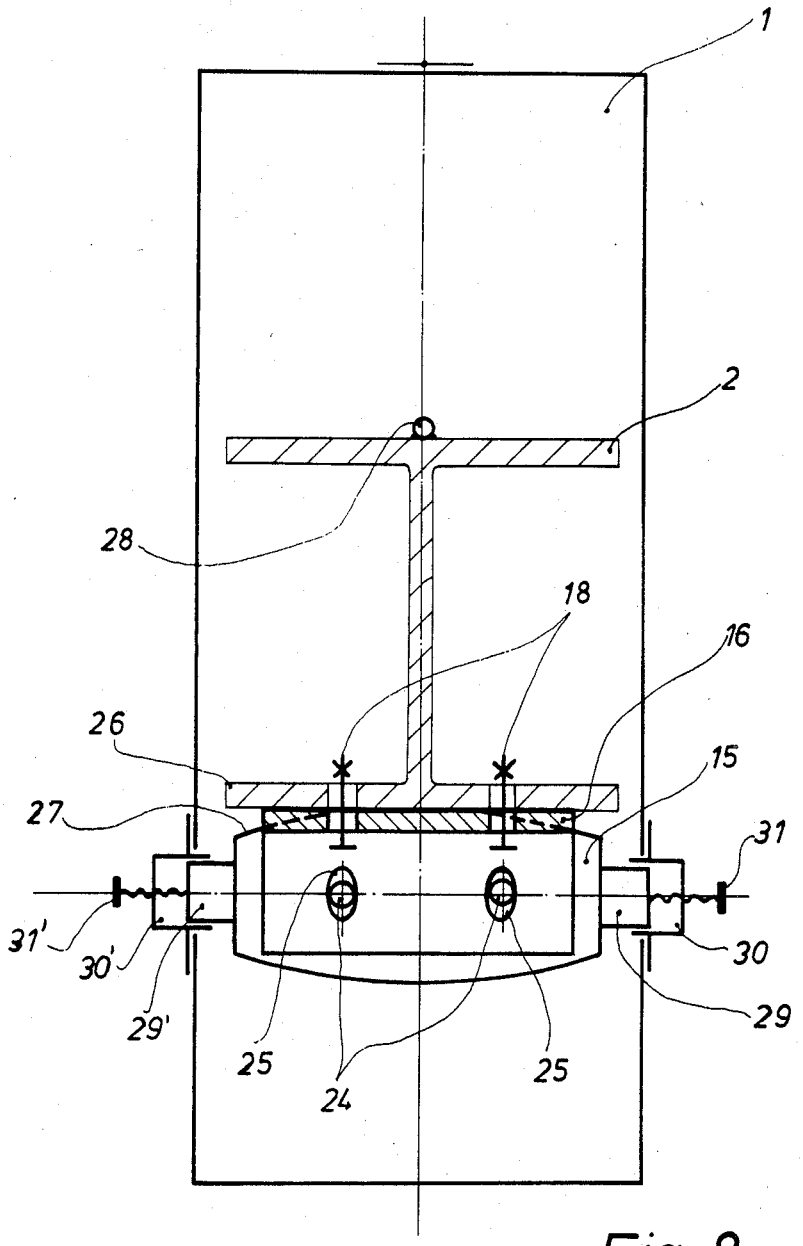
FIG. 8 is a schematic representation of a part for mounting the pivot axis of the horse-head piece which enables the tilting movement of the latter, shown in a cross-section and in an intermediate position.
Figure 9:
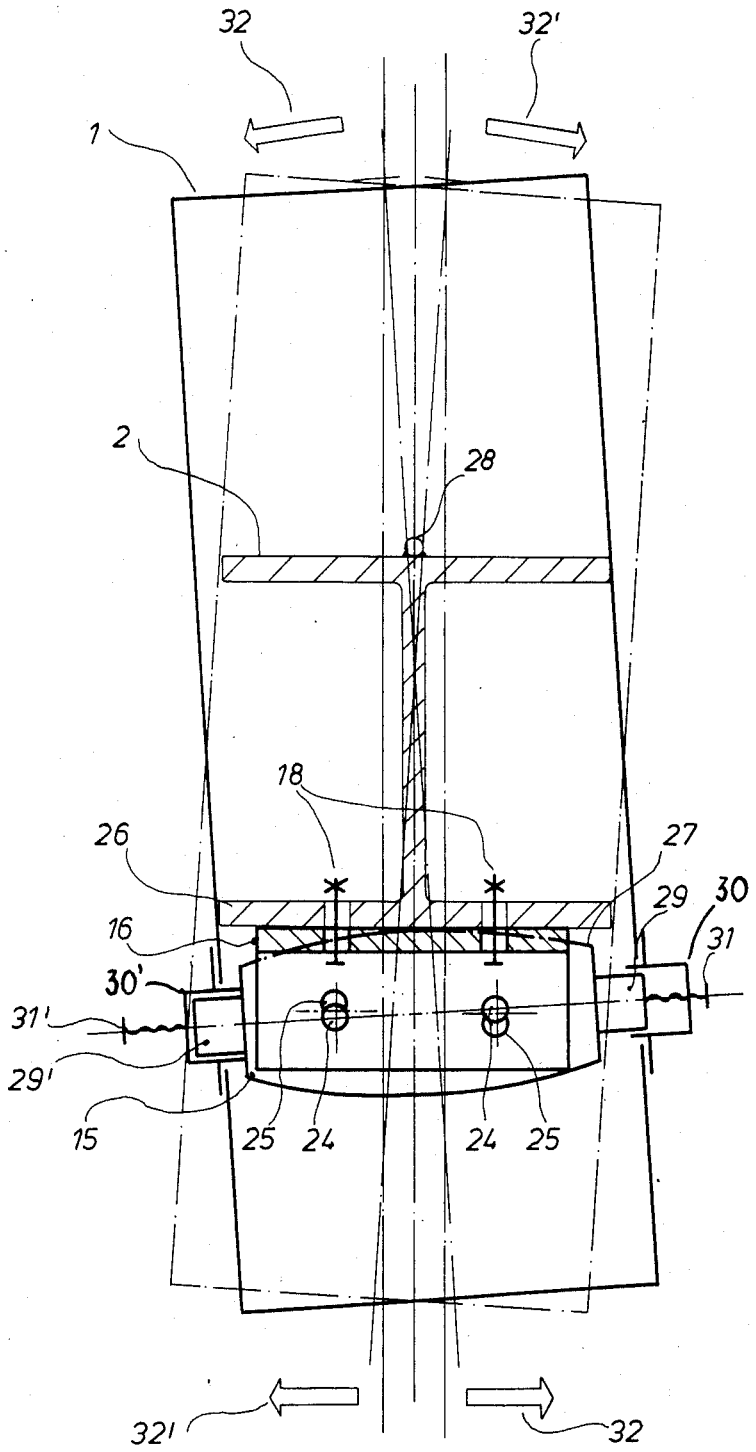
FIG. 9 shows the mounting part of FIG. 8 with an extreme angular position of the horse-head piece.

Referring now to FIGS. 8 and 9, there is illustrated a construction and operation of a mount for the pivot axis 15, the mount being tiltable about an axis which extends parallel to the longitudinal axis of the rocking beam 2. By means of this adjustable mount, the horse-head piece 1 can be accurately adjusted relative to the polished rod 5 in the longitudinal direction of the rocking beam 2.

The pivot axle 15 is fastened by means of two screws 24 which extend approximately parallel to the longitudinal axis of the rocking beam 2, and pass through holes 25 in the bearing bushing 16. The center points of the two mounting holes 25 are spaced an equal distance from a bottom web 26 of the rocking beam 2. The upper surface 27 of the axle 15 which rests on the web 26, has a convex shape. Consequently, to the extent which is defined by the size of the mounting holes 25, after releasing the screws 24 the tilting movement of the axle 15 is made possible about an axis which extends perpendicularly to the plane of FIG. 8. During this tilting movement, the convex surface of the axle 15 lies on the web 26 of the rocking beam. The pivot point 28 in FIGS. 8 and 9 serves for pivotably supporting the horse-head piece 1 and simultaneously serves for guiding the axle 15 during its sliding movement on the web 26.

The axle 15 is terminated at both ends thereof by axial pins 29 and 29' which are supported in bearing bushings 30, 30'. The bearing bushings are rigidly connected to the horse-head piece 1 whereas the bearing bushings 30, 30' which are provided with lubricating means, are provided with adjusting screws 31 and 31'. By rotating the edge of fixed screws, the position of the axial pins 29, 29' in the bushings is changed.

In order to impart to the horse-head piece 1 a tilting movement in the direction of arrows 32 or 32' about the turning point 28, the adjustment screws 31 and 31, must be correspondingly actuated so that the resulting shift of the axial pins 29 and 29' in their bearing bushings 30, 30' and in cooperation with the turning element 28 which performs a guiding function, a sliding movement of the upper surface 27 of the axle 15 on the web 26 causes the horse-head piece 1 to take a corresponding inclined position. In FIG. 8, the maximum possible inclined positions of the horse-head piece 1 are illustrated in full and dashed lines.

It will be seen that the shiftability of the mounts of the horse-head piece 1 in the direction of the longitudinal axis of the rocking beam, in connection with its tiltability about an axis which extends parallel to the axis of the rocking beam 2, makes it possible to achieve an accurate alignment of the polished rod 5 relative to the horse-head piece 1.

Figure 10:
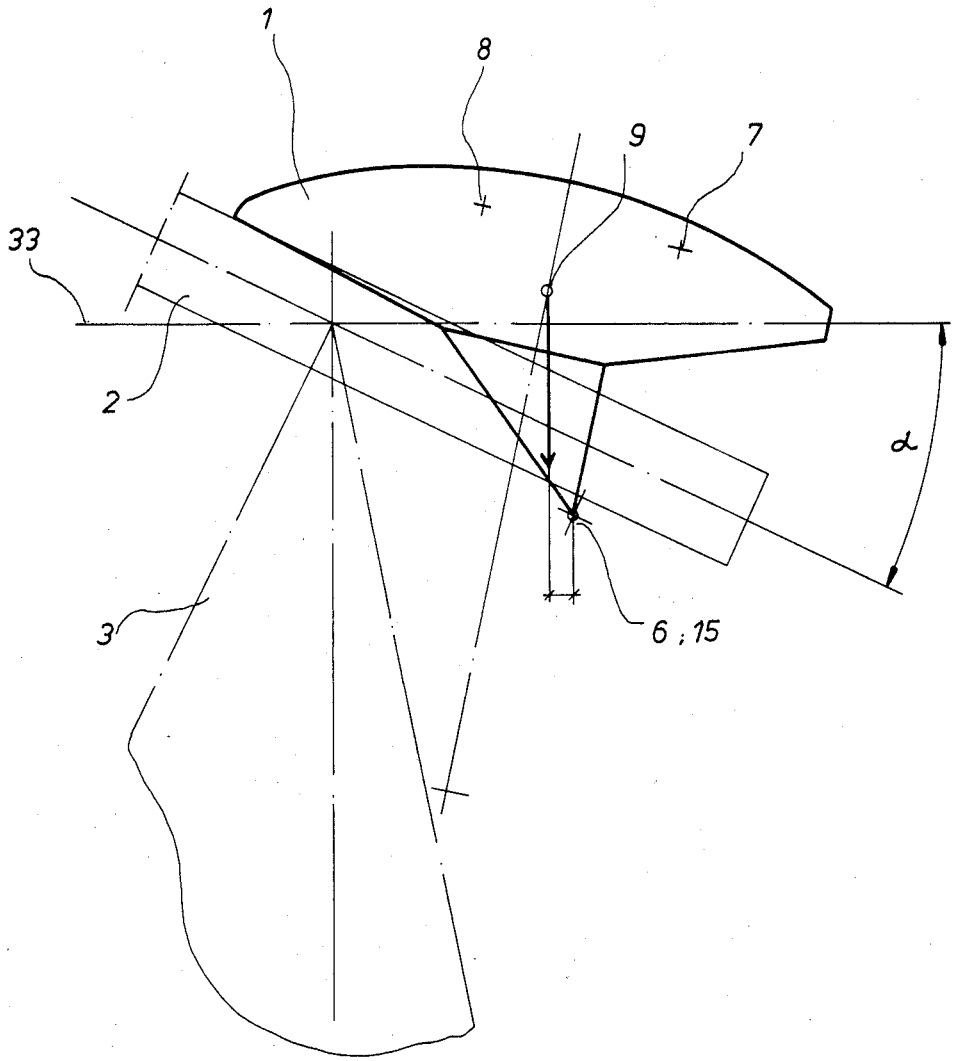
FIG. 10 is a schematic side view of a drive member for a pumping installation according to this invention, shown in an extreme angular position of the rocking beam.

FIG. 10 illustrates another feature of the horse-head shaped component 1 in the pump drive of this invention, particularly bearing means which produce an improved operational safety. According to the maximum inclination angle A relative to a horizontal plane 33, the axle 6 or the tiltable axle 15 are arranged relative to the center of gravity 9 of the horse-head piece 1 in such a manner the latter under the force of gravity is held in this swung back position automatically. Consequently an unintended swing over of the horse-head piece 1 into its working position (FIG. 3) is effectively avoided. This locking effect is achieved due to the fact that the axis 6 in this angular position of the rocking beam 2 is offset relative to the center of gravity 9 in the direction of the bore hole and consequently the force of gravity exerts a moment or a force component on the horse-head piece 1 which holds the latter in the swung back position on the axle 6. Accordingly, the horse-head piece 1 is secured in all possible angular positions of the rocking beam 2 against an unintended swinging movement in backward direction.

It will be understood that each of the elements described above, or two or more together, may also find a useful application in other types of constructions differing from the types described above.

While the invention has been illustrated and described as embodied in a drive for a cornish type pump for use in deep well pumping operation, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A pump drive for a deep well pumping installation, including a stand, a rocking beam supported for rocking movement about a substantially horizontal axis on the stand, and a horse-head shaped transmission part engageable with a pumping rod in the well, the horse-head transmission part being pivotally supported on the rocking beam about an axis which extends substantially transversely to the longitudinal axis of the rocking beam to allow tilting movement of the horse-head transmission part in the direction of the stand, said horse-head transmission part comprising two force application points spaced apart one from the other and from a center of gravity of the horse-head transmission part whereby to the latter a forward or a backward tilting movement about its pivot axis can be imparted, the force application points being arranged relative to said center of gravity and to said pivot axis such that during the tilting movement of the horse-head transmission part in either direction the center of gravity precedes only that force application point being used in going past their respective top dead center points on their paths of movement, and further comprising mounting means for the tiltable horse-head transmission part on the rocking beam, the mounting means being shiftable in longitudinal direction of the rocking beam and in addition being pivotable about an axis which extends parallel to the longitudinal axis of the rocking beam.

2. A pump drive as defined in claim 1 wherein said mounting means include an axle whose end portions are connected to the horse-head shaped transmission part, said axle being shiftable in a direction parallel to the longitudinal axis of the rocking beam.

3. A pump drive as defined in claim 2 wherein said axle is supported in a bearing block which is shiftably mounted along the longitudinal axis of the rocking beam.

4. A pump drive as defined in claim 3 wherein said bearing block is coupled to a spindle which is actuated at one point for displacing the bearing block together with said axle in the longitudinal direction of the rocking beam.

5. A pump drive as defined in claim 2 wherein said axle is tiltable within its bearing block about an axis which extends parallel to the longitudinal axis of the rocking beam.

6. A pump drive as defined in claim 5 wherein said axle has a convex bearing surface whose center axis extends parallel to the longitudinal axis of the rocking beam, said horse-head transmission part being connected to the rocking beam at a turning point which permits its rotation about an axis which extends parallel to the longitudinal axis of the rocking beam.

7. A pump drive as defined in claim 2 wherein said axle is non-rotatably supported in its bearing block, said bearing block being provided with oblong holes for receiving fastening screws, the end portions of said axle being formed with cylindrical pins supported in bearing bushings which are directly secured to the horse-head transmission part, and the cylindrical pins being adjustably guided in the bearing bushings.

8. A pump drive for a deep well pumping installation, including a stand, a rocking beam supported for rocking movement about a substantially horizontal axis on the stand, and a horse-head shaped transmission part engageable with a pumping rod in the well, the horse-head transmission part being pivotally supported on the rocking beam about a pivot axis which extends substantially transversely to the longitudinal axis of the rocking beam to allow tilting movement of the transmission part in the direction of the stand, said horse-head transmission part comprising two force application points spaced apart one from the other and from a center of gravity of the transmission part, the force application points being arranged relative to said center of gravity and to said pivot axis such that during the tilting movement of the horse-head transmission part in either direction a force application point being used always goes past its top dead center point, and the center of gravity precedes the force application point being used in going past their respective top dead center points, and said application points including hooked eyelets for attaching a pulling rope to lateral sides of the horse-head transmission part.

* * * * *